United States Patent [19]

Muccitelli

[11] Patent Number: 4,827,959

[45] Date of Patent: May 9, 1989

[54] MONITORING AND CONTROLLING AVT (ALL VOLATILE TREATMENT) AND OTHER TREATMENT PROGRAMS FOR HIGH PRESSURE BOILERS VIA THE CONDUCTIVITY CONTROL METHOD

[76] Inventor: John A. Muccitelli, 564 Feaster Ave., Feasterville, Pa. 19047

[21] Appl. No.: 188,801

[22] Filed: May 3, 1988

[51] Int. Cl.[4] ..... F22B 37/54

[52] U.S. Cl. ..... 137/2; 122/382

[58] Field of Search ..... 137/1, 2; 122/396, 382; 210/696, 739, 746; 340/540, 603

[56] References Cited

U.S. PATENT DOCUMENTS

| | | | |
|---|---|---|---|
| 4,285,302 | 8/1981 | Kelly | 122/382 |
| 4,406,794 | 9/1983 | Brigante | 122/382 X |
| 4,465,026 | 8/1984 | Carberry | 122/396 X |
| 4,639,718 | 1/1987 | Gaspar | 340/540 X |

*Primary Examiner*—Alan Cohan

*Attorney, Agent, or Firm*—Caesar, Rivise, Bernstein, Cohen & Pokotilow, Ltd.

[57] ABSTRACT

A method for monitoring and controlling the blowdown rate and chemical feed rate to a high pressure boiler involving the measurement of certain parameters including operating temperature, conductivity at operating temperature, temperature and pH of cooled boiler water, and then carrying out calculations to determine the estimated treatment chemical concentration and estimated boiler water conductivity, noting the critical conductivity ratio (CCR), noting the observed maximum tolerable high temperature conductivity value and comparing the relative conductivity ratio (RCR) with the critical conductivity ratio (CCR) and the value of the electrolytic conductivity of the boiler water at operating temperature (K) with the maximum tolerable high temperature conductivity value (M), followed by making any necessary adjustments to the chemical feedrate and diagonal or blowdown rate depending upon aforesaid comparison.

6 Claims, No Drawings

MONITORING AND CONTROLLING AVT (ALL VOLATILE TREATMENT) AND OTHER TREATMENT PROGRAMS FOR HIGH PRESSURE BOILERS VIA THE CONDUCTIVITY CONTROL METHOD

FIELD OF THE INVENTION

This invention relates generally to high pressure boilers operating generally greater than 1000 psig. Such high pressure boilers cannot tolerate very high concentrations of dissolved solids in boiler water because of the danger of carryover of contaminants into the steam. Such carryover can result in damage to turbines caused by corrosion and deposit formation. In boilers used in the power industry, a condition of "near-zero solids" in the boiler water is maintained while providing a degree of protection against corrosion via AVT (All Volatile Treatment) and other internal treatment programs.

AVT involves the application of various volatile materials, principally hydrazine and ammonia, but sometimes cyclohexylamine and morpholine. These materials neutralize acidic corrosion products and maintain an alkaline condition in the boiler which is beneficial to the boiler metal and its protective magnetite (iron oxide) film. Hydrazine, used as an oxygen scavenger and reducing agent, decomposes very rapidly to ammonia in the boiler.

pH, measured on a cooled boiler water sample, is the major control parameter for AVT and is generally maintained at or near a value of 9.5. This pH value is believed to be the highest that can be maintained without significant corrosion by ammonia of copper and copper-bearing alloys which are usually found in condensate equipment and heaters. A major risk in the application of AVT is that upsets in feedwater or returned condensate may easily exceed the buffer capacity of the boiler water, resulting in corrosion. Leakage of alkali metals from demineralizers can also lead to caustic corrosion. Often, boiler water conductivity values (measured on a cooled blowdown sample) are maintained within a range of about 10–30 uS/cm.

In spite of serious disadvantages, the control of treatment programs based on pH values of boiler water samples which have been cooled to near ambient temperature is common practice. For example, two boiler water samples can exhibit the same pH at ambient temperature, but have widely differing values at the actual operating temperature of the boiler. This will depend on the temperature dependence of the hydrolyses of the treatment chemicals and contaminants as well as their concentrations and the degree of corrosion ongoing at the elevated temperatures in the boiler (which generally produces acidic species).

Similarly, control based on boiler blowdown conductivity values suffers from shortcomings arising from the nonspecific nature of this parameter. Traditional control methods based on blowdown pH and conductivity determined together on cooled boiler samples slightly improve reliability but still suffer from the inherent drawbacks of the individual techniques. They tend to be used empirically on the basis of experience rather than fundamentally on the basis of the intrinsic beneficial properties of the boiler water solution.

SUMMARY OF THE INVENTION

The present invention provides an on-line method of monitoring the degree of control provided by AVT and other internal treatment programs, such as chelant, polymer, or phosphate-based programs, based on the novel concept of the relative conductivity ratio (RCR). The objective of the invention is a means to estimate a reliable value of the buffering capacity of the boiler water at operating temperature under pH conditions where the solubility of magnetite is as low as is practically possible under a given treatment program, while simultaneously monitoring boiler water quality and maintaining correct levels of treatment chemicals. This will have the combined desired effects of assuring minimum damage from acidic corrosion resulting from minor upsets in feedwater quality; controlling to maintain an optimum chemical environment for the protective magnetite film during normal operation as well as during upsets, and monitoring the effect on boiler water quality of undesirable, extraneous ions, other than those comprising the water treatment.

DETAILED DESCRIPTION OF THE PREFERRED EMBODIMENT

The present invention provides a method to maintain sufficient buffer capacity in the boiler water by controlling the feedrate of a treatment chemical using parameters determined from in-situ high temperature conductivity measurements which provide a sensitive gauge of corrosive conditions within the boiler. Diethanolamine is a preferred treatment chemical in accordance with the present invention.

The method of the present invention involves the chemical feed of a pH control agent, such as morpholine or diethanolamine, to boiler water based on a control parameter which is obtained by comparing measured high temperature boiler water conductivity values with those calculated from low, or ambient, temperature pH measurements performed on cooled boiler water samples. The purpose of the invention is to prevent corrosion of the protective magnetite layer on the internal surfaces of boilers.

Other than the treatment chemical itself, the method of the present invention is comprised of three elements: Measurement, Computation, and Control. Specifically, the method is defined in terms of these elements as follows:

A. Measurement

1. Measure the temperature of the boiler water. This is the operating temperature of the boiler. Alternatively, the temperature of a sample of water removed from the boiler and still at some elevated temperature may be measured. For the sake of simplicity this will be referred to as the operating temperature of the boiler, even though it will be lower. To the same effect the measurement of the electrolytic conductivity of the boiler water of the next paragraph will also be referred to as at operating temperature even though the sample has been removed from the boiler.

2. Measure the electrolytic conductivity of the boiler water at the operating temperature or at other elevated temperature based on the sample of the previous paragraph. This value is designated K and may be determined using a newly developed probe utilizing stabilized zirconia to resist the harmful effects of boiler water at the operating temperature as set forth in soon to be filed Application Ser. No. 07/203,779, filed June 7, 1988, inventor John A. Muccitelli and Nancy Feldman, entitled Electrode Assembly for In-Situ Measurement of Electrolytic Conductivity of Boiler Water.

3. Measure the temperature of a boiler water sample which has been cooled to within the operating range of a glass pH electrode. This is the value of the ambient temperature.

4. Measure the pH of the boiler water sample which has been cooled to ambient temperature.

B. Computation

1. From the boiler water pH measured at ambient temperature (measurement A4), calculate an estimated treatment chemical concentration, C, from a charge balance equation which contains only terms involving the treatment chemical species and ions arising from the dissociation of water. An example of such charge balance equation as will readily occur to one skilled in the art is:

$$\Sigma_i C_i Z_i = 0$$

where $C_i$ is the concentration of the ith ionic species with charge Zi.

2. From the value C, the values for the equivalent conductances of the treatment chemical ions (including hydronium and hydroxyl), and the dissociation constants for the treatment chemical and water, calculate an estimate for the boiler water conductivity at operating temperature from Kohlrausch's law. This is done by using the equation:

$$K' = \Sigma_i C_i \lambda_i / 1000$$

where $C_i$ is the concentration of the ith ionic species which has an equivalent conductance, and $\lambda_i$ is the equivalent conductance of the ith species. This estimate is designated K.

3. From the measured boiler water conductivity, K (measurement A2), and the calculated estimated boiler water conductivity, K', at operating temperature, calculate a value for the Relative Conductivity Ratio (RCR), defined as $$RCR = K'/(|K - K'|)$$

C. Control—CCR is a control parameter called the Critical Conductivity Ratio

1. If the value of RCR>CCR and if K<M, where M is a maximum tolerable high temperature conductivity value, then the boiler chemistry is under control and the current rate of chemical feed is continued. The value M marks a conductivity value above which appreciable and intolerable steam contamination will occur.

2. If K>M, then the blowdown rate is increased until K<M.

3. If the value of RCR<CCR, then the chemical feedrate is increased until RCR>CCR.

4. If the value of RCR<CCR, and if K>M, then the chemical feedrate and the blowdown rate are simultaneously increased until RCR>CCR and K<M.

Further Details of the Preferred Embodiment

At this point, it is useful to discuss several aspects of the Control feature of the present invention. First the present method is intended to be implemented through the use of chemical feed and blowdown systems under computer control using the four measured quantities as input. In addition to the control limits CCR and M, there may be other parameters, for example, limits on pH and ambient temperature conductivity, which may also be involved for control of a particular boiler system. These would, however, in no way affect the implementation of the methodology of the present invention.

As noted above, one factor indicating that boiler chemistry is under control is that the relative conductivity ratio (RCR) is greater than the critical conductivity ratio (CCR). For this reason, the value of CCR—critical conductivity ratio—(a physical observation) is the level below which significant corrosion of the protective magnetite layer on the boiler walls is observed. Thus, when RCR (calculated) drops below CCR (observed), significant corrosion of the protective magnetite layer on the boiler walls will be observed Furthermore, when the RCR drops below CCR, the pH of the boiler water calculated from the estimated treatment chemical concentration, C, at the operating temperature begins to differ significantly (e.g., by more than a tenth of a pH unit) from the actual boiler water pH.

Determination of CCR and M

The Critical Conductivity Ratio (CCR) can be determined empirically by analyzing for iron in boiler water and plotting the concentrations against the computed RCR values for the system. However, in operating boilers, this is not always feasible without risking serious corrosion associated with obtaining low RCR values. A more practical method for determination of CCR is to perform a rigorous chemical analysis on the boiler water to identify the principal electrolytic species present. From these data, together with the necessary dissociation constants and equivalent conductances, accurate boiler water pH values can be computed.

Then by hypothetically increasing or decreasing concentrations of the treatment chemical and the principal boiler water contaminants, via computational methods, a value of CCR can be obtained by noting where the pH values calculated from C for various RCR values differ from the actual boiler water pH values by more than, say, a tenth of a pH unit.

The maximum tolerable high temperature conductivity value, M, is directly analogous to, and will correlate with, the current ambient temperature conductivity limits for boiler water set by turbine manufacturers to ensure steam purity. Although this parameter is not related to internal corrosion of the boilers, a it is used in the CCR program as a precaution against massive influxes of contaminants.

Typical chemical feedrates used in the practice of the present invention are determined by the type and quantity of the contaminant loading in the boiler water. The contaminant loading is assessed via periodic rigorous chemical analysis of the boiler water and knowledge of the processes for which the boiler system provides steam. In the event of upset conditions, i.e., when RCR<CCR, the chemical feed may be increased at a rate which is a function of the reciprocal of CCR, or some other suitable function.

EXAMPLES

Research Boiler experiments were performed to demonstrate the validity of the concept that, for certain treatment chemicals, the RCR can provide an indication of the degree of magnetite corrosion and that above some critical value, CCR, corrosion is reduced to some small value. Although computer control was not used in the Research Boiler experiments, the results demonstrate both the novelty and utility of the invention.

The general procedure for a Research Boiler experiment was as follows: A Research Boiler was fitted with a high temperature conductance electrode, an RTD for precise temperature measurement, a chemical feed system, and a heated feedwater tank. Demineralized feedwater was heated to about 150° F. and continuously sparged with nitrogen to remove atmospheric carbon dioxide and oxygen. Treatment chemicals and contaminants were fed into the feedwater line just prior to its entry into the steam drum.

The boiler operated continuously for 10 days at 1000 psig (approx. 280° C.) at 15 cycles of concentration under a heat flux of 185,000 Btu/sq.ft/hr. For the first 5 days of operation, only treatment chemical was added to the boiler. This allowed sufficient time for the boiler to cleanse itself of residual chemicals and contaminants from previous runs. High temperature conductivity was continuously monitored and the beginning of the run was considered to occur when the conductivity reached a steady value. The maximum tolerable high temperature conductivity limit was not set for the boiler water in the run. Blowdown rate remained constant throughout the experiment.

During the CCR run, chemical feed of treatment and contaminant was varied every day. A period of about 24 hours was allowed for the system to stabilize after a change in boiler chemistry. The criterion used to indicate that the boiler had attained a steady state was the invariance of the high temperature conductivity values with time. Once steady state was attained, cooled boiler blowdown samples were taken and analyzed for treatment chemical and both intentionally added and extraneous contaminant concentrations. The added contaminants included trace levels of silica and ammonia. The samples were also analyzed for iron. Ambient temperature was recorded along with the conductivity and pH which were continuously measured on the cooled blowdown stream. Chemical analyses were also performed on the boiler feedwater and the contents of the chemical feed reservoirs.

The data from these Research Boiler experiments were handled as follows:

RCR values were computed from K and K', which was determined from the value of C estimated from the ambient temperature pH measurement and appropriate dissociation constants and equivalent conductances. Estimated values for K were determined from the results of the chemical analyses (using the appropriate equilibrium constants and equivalent conductances of all species present) and compared with the experimental values of K. A similar comparison was made for ambient temperature conductivity values. Actual boiler water pH values were computed for both operating and ambient temperatures from the results of the chemical analyses. In addition, pH values were calculated for boiler water at the operating temperature based only on the estimated treatment concentration, obtained from the ambient temperature pH measurement.

Agreement between the experimentally measured ambient temperature conductivity and pH values and those calculated from the results of the chemical analyses, as well as agreement between the observe and calculated high temperature conductivity values, provided criteria for the accuracy of the high temperature boiler water pH values computed from the results of the chemical analyses.

The results of a Research Boiler experiment using morpholine are presented in Tables IA and IB (see also Plot I of the attached drawing).

TABLE IA

CCR Results for Morpholine at 1000 psig (280° C.)* at 15 Cycles (Run 1)

| | ppm in Feedwater | | | Boiler | | | |
|---|---|---|---|---|---|---|---|
| Day | Morph. | Acetic Acid | NaCl | pH(280) from C | Boiler pH(280) | RCR | ppb Fe in Boiler |
| 1 | 53 | 0.0 | 0.00 | 6.4 | 6.5 | 0.64 | 28 |
| 2 | 54 | 2.8 | 0.37 | 6.3 | 6.0 | 0.12 | 180 |
| 3 | 136 | 3.0 | 0.39 | 6.4 | 6.2 | 0.14 | 90 |
| 4 | 273 | 3.0 | 0.37 | 6.5 | 6.4 | 0.19 | 3 |
| 5 | 278 | 0.9 | 0.03 | 6.6 | 6.6 | 0.98 | 6 |

TABLE IB

Experimental and Calculated Values of pH and Conductivity for Morpholine at 1000 psig (280° C.) at 15 Cycles (Run 1)

| | Experimental Measurements | | | Calculated Values | | | |
|---|---|---|---|---|---|---|---|
| Day | pH Ambient | K(uS) Ambient | K(uS) 280 | pH Ambient | K(uS) Ambient | K(uS) 280 | K'(uS) 280 |
| 1 | 9.50 | 19 | 54 | 9.6 | 16 | 45 | 21 |
| 2 | 9.43 | 33 | 180 | 9.3 | 30 | 154 | 19 |
| 3 | 9.50 | 39 | 204 | 9.5 | 35 | 185 | 25 |
| 4 | 9.74 | 44 | 228 | 9.7 | 41 | 206 | 36 |
| 5 | 9.83 | 53 | 89 | 9.8 | 28 | 103 | 44 |

*Tables IA, IB, IIA, IIB, IIIA, IIIB, IVA and IVB at times use "280" which is intended to mean 280° C.

The data in Table IA indicate that there is a general correlation between low values of RCR and high iron concentrations in the boiler water. Since no iron was added to the boiler during the run, its presence in the boiler water is indicative of corrosion, or wastage of the protective magnetite layer from the boiler walls. Note also that when RCR>0.6 (Days 1 and 5), the agreement between the estimated pH value calculated from C is within a tenth of a unit of the actual boiler water pH at operating temperature. This indicates that the treatment chemical dominates the acid/base chemistry of the system under these conditions. The only apparent anomaly in the data occurs at Day 4, where, even though small boiler water iron concentrations are observed, the RCR is still very small. Thus, low values of RCR do not guarantee that corrosion will be severe in all cases, for example, when the feedrate of the treatment chemical is extremely high. It should be pointed out that the actual and estimated boiler water pH values agree in this case. The experimental and calculated values given in Table IB are found to be in good agreement.

The results of a Research Boiler experiment using morpholine at lower treatment chemical and acidic contaminant concentrations are presented in Tables IIA and IIB.

Although under lower concentrations, the trends in the data presented in Tables IIA and IIB are nearly identical to those observed for the previous results obtained for morpholine.

A Research Boiler experiment was performed using a different treatment chemical, diethanolamine (DEA). This material has certain advantages over morpholine for the control of pH in high pressure boilers. It exhibits a steam/water distribution ratio which is about a tenth of that of morpholine at 1000 psig. This results in a much greater buffer capacity in the boiler water under comparable chemical feedrates. The material also has a higher basicity than morpholine at elevated temperatures which results in a more alkaline boiler water under operating conditions. The results of the experiment are presented in Tables IIIA and IIIB.

TABLE IIA

CCR Results for Morpholine at 1000 psig (280° C.) at 15 Cycles (Run 2)

| | ppm in Feedwater | | | Boiler | | | |
|---|---|---|---|---|---|---|---|
| Day | Morph. | Acetic Acid | NaCl | pH(280) from C | Boiler pH(280) | RCR | ppb Fe in Boiler |
| 1 | 30 | 0.0 | 0.00 | 6.3 | 6.4 | 0.64 | <1 |
| 2 | 24 | 1.6 | 0.51 | 6.0 | 6.2 | 0.05 | 20 |
| 3 | 63 | 2.4 | 0.58 | 6.3 | 6.3 | 0.09 | 10 |
| 4 | 133 | 2.1 | 0.59 | 6.4 | 6.4 | 0.13 | <1 |
| 5 | 31 | 0.0 | 0.03 | 6.3 | 6.3 | 0.59 | 5 |

TABLE IIB

Experimental and Calculated Values of pH and Conductivity for Morpholine at 1000 psig (280° C.) at 15 Cycles (Run 2)

| | Experimental Measurements | | | Calculated Values | | | |
|---|---|---|---|---|---|---|---|
| Day | pH Ambient | K(uS) Ambient | K(uS) 280 | pH Ambient | K(uS) Ambient | K(uS) 280 | K'(uS) 280 |
| 1 | 9.48 | 13 | 50 | 9.5 | 13 | 43 | 20 |
| 2 | 9.09 | 29 | 183 | 9.3 | 27 | 151 | 9 |
| 3 | 9.41 | 36 | 209 | 9.3 | 34 | 198 | 18 |
| 4 | 9.60 | 41 | 219 | 9.5 | 41 | 219 | 26 |
| 5 | 9.48 | 14 | 54 | 9.5 | 12 | 24 | 20 |

TABLE IIIA

CCR Results for Diethanolamine at 1000 psig (280° C.) at 15 Cycles

| | ppm in Feedwater | | | Boiler | | | |
|---|---|---|---|---|---|---|---|
| Day | DEA | Acetic Acid | NaCl | pH(280) from C | Boiler pH(280) | RCR | ppb Fe in Boiler |
| 1 | 39 | 0.0 | 0.18 | 6.8 | 6.9 | 1.6 | 47 |
| 2 | 31 | 0.7 | 0.27 | 6.7 | 6.7 | 0.52 | 57 |
| 3 | 62 | 0.6 | 0.31 | 6.9 | 6.9 | 0.83 | 27 |
| 4 | 68 | 1.8 | 1.00 | 7.0 | 6.8 | 0.45 | 85 |
| 5 | 33 | 0.4 | 0.00 | 6.9 | 6.9 | 13. | 39 |

TABLE IIIB

Experimental and Calculated Values of pH and Conductivity for Diethanolamine at 1000 psig (280° C) at 15 Cycles

| | Experimental Measurements | | | Calculated Values | | | |
|---|---|---|---|---|---|---|---|
| Day | pH Ambient | K(uS) Ambient | K(uS) 280 | pH Ambient | K(uS) Ambient | K(uS) 280 | K'(uS) 280 |
| 1 | 9.84 | 36 | 104 | 9.9 | 37 | 104 | 64 |
| 2 | 9.75 | 42 | 152 | 9.8 | 38 | 166 | 52 |
| 3 | 10.04 | 64 | 233 | 10.0 | 62 | 251 | 106 |
| 4 | 10.06 | 84 | 359 | 10.1 | 87 | 487 | 113 |
| 5 | 10.03 | 33 | 97 | 10.0 | 33 | 99 | 104 |

The results presented in Table IIIA indicate that, as in the case for morpholine, there is a clear correlation between low RCR values and magnetite corrosion. Although the baseline iron concentrations are higher than those for morpholine, control based on RCR is still possible. Note also that the pH of the boiler water is controlled at values higher than those observed for morpholine. The agreement between the experimental and calculated values presented in Table IIIA is excellent except for Day 4 where both treatment chemical and contaminant concentrations are high.

A Research Boiler experiment was performed using 4-(aminomethyl)piperidine (4-AMP). This molecule was expected to have the same advantages over morpholine for pH control as did diethanolamine. It is much more basic than morpholine at high temperatures and also exhibits a vapor/liquid distribution ratio which is about a third of that of morpholine. The results of the boiler run performed with low concentrations of the treatment chemical and contaminants are given in Tables IVA and IVB.

TABLE IVA

CCR Results for 4-(Aminomethyl)piperidine at 1000 psig (280° C.) at 15 Cycles

| | ppm in Feedwater | | | Boiler | | | |
|---|---|---|---|---|---|---|---|
| Day | 4-AMP | Acetic Acid | NaCl | pH(280) from C | Boiler pH(280) | RCR | ppb Fe in Boiler |
| 1 | 9.8 | 0.0 | 0.0 | 6.9 | 6.9 | 5.8 | 230 |
| 2 | 8.1 | 0.2 | 0.09 | 6.9 | 6.8 | 3.1 | 230 |
| 3 | 25 | 0.3 | 0.13 | 7.1 | 7.1 | 38 | 155 |
| 4 | 9.7 | 0.0 | 0.14 | 6.9 | 6.9 | 14 | 240 |
| 5 | 8 | 0.9 | 0.5 | 6.8 | 6.7 | 0.6 | 200 |

TABLE IVB

Experimental and Calculated Values of pH and Conductivity for 4-(Aminomethyl)piperidine at 1000 psig (280° C.) at 15 Cycles

| | Experimental Measurements | | | Calculated Values | | | |
|---|---|---|---|---|---|---|---|
| Day | pH Ambient | K(uS) Ambient | K(uS) 280 | pH Ambient | K(uS) Ambient | K(uS) 280 | K'(uS) 280 |
| 1 | 10.29 | 53 | 89 | 10.1 | 55 | 92 | 102 |
| 2 | 10.17 | 49 | 111 | 10.0 | 50 | 114 | 84 |
| 3 | 10.50 | 102 | 154 | 10.3 | 112 | 212 | 150 |
| 4 | 10.18 | 54 | 92 | 10.1 | 57 | 129 | 86 |
| 5 | 10.01 | 60 | 197 | 9.9 | 60 | 233 | 72 |

The most striking feature of the results in Table IVA is the remarkably high boiler water iron concentrations, regardless of the values for RCR. This indicates that the treatment chemical itself is corrosive to the boiler and is not suitable for use in a CCR program. This is a surprising and unexpected result. Note the agreement between the experimental and calculated values presented in Table IVB.

From Tables I through IV, the correlation between magnetite corrosion and RCR for morpholine and diethanolamine is extremely clear and provides a sound basis for corrosion control via the CCR method using these materials. Furthermore, the failure of 4-(aminomethyl)piperidine of Table IV is readily apparent.

FEATURES OF METHOD OF CONTROL

There are several noteworthy features of this method of control. Although it is a novel and unconventional way to employ high temperature conductivity measurements in determining boiler water quality, it is nonetheless, compatible with the more traditional conductivity methods. For example, the novel method may be used in conjunction with he standard practice of controlling boiler water quality on the basis of some maximum allowable conductivity value to assure a high level of steam purity, in addition to corrosion protection. In this respect, the method is also fully compatible with and may be used in conjunction with the traditional methods of determining steam purity, such as cation conductivity. The method is applicable for both circulating and once-through boiler systems.

Although the method of this invention is intended principally for use with AVT, the scope of the method is not limited to such applications. The method can be employed to control corrosion in a boiler when using virtually any hydrolytic treatment chemical added for pH control. This includes acidic as well as basic materials, regardless of their volatility or whether they are organic or inorganic in nature. The method can be applied even when materials which are hydrothermally unstable are used as treatment chemicals, so long as the kinetics of their decomposition can be reasonably characterized.

The method of this invention is especially suited for implementation involving microprocessor techniques. The numerical results of the relatively complex requisite calculations, in conjunction with on-line data acquisition, can provide the basis for controlling the chemical feed pumps and alarm systems.

Perhaps the most important feature of the method of this invention is that it provides a reliable means to distinguish the source and nature of observed changes in boiler water conductivity during operation. (Other than those generally observed during start up and shut down of the system.) That is, the method can be used to determine whether an increase in the boiler water conductivity is caused by an increase in chemical feedrate or by a sudden ingress, or slow accumulation, of impurities in the boiler water, or perhaps by both.

It is thus seen that the method of this invention achieves an estimate of a reliable value of the buffering capacity of the boiler water at operating temperature under pH conditions where the solubility of the protective magnetite layer on the walls is low as is practically possible under a given treatment program, while simultaneously monitoring boiler water quality and maintaining correct levels of treatment chemicals.

The method of the present invention entails measurement of the operating temperature and conductivity (K) of the boiler water at the operating temperature, as well as measurement of the temperature and pH of the cooled boiler water. This is followed by calculation of (1) the estimated treatment chemical concentration (C) from a charge balance equation; (2) calculation of an estimated boiler water conductivity (K') using (C) and (3) calculation of RCR using K and K'. Also, CCR is the level below which significant corrosion of the protective magnetite layer on the boiler walls is observed. Also, (M) is the observed maximum tolerable high temperature conductivity value.

Thus, the observed or measured parameters are K; M and CCR and RCR is calculated using K and K' where K' has been calculated from Kohlrausch's law using C which was in turn a calculated estimated treatment chemical concentration, with such calculation coming from a charge balance.

With the foregoing in mind, the boiler chemistry is under control and the current rate of chemical feed may be continued when:

$$RCR > CCR \text{ and } K < M$$

Without further elaboration, the foregoing will so fully illustrate my invention that others may, by applying future knowledge, adopt the same for use under various conditions of service.

What is claimed as the invention is:

1. A method for monitoring and controlling the blowdown rate and chemical feedrate to a high pressure boiler having a protective magnetite layer on its walls, said method involving conductivity control and comprising measurement of:

(1) the operating temperature and (2) the conductivity (K) of the boiler water at operating temperature, said method further comprising measurement of:

(3) the temperature of the boiler water cooled to ambient temperature (4) pH of the boiler water cooled to ambient temperature, with the further steps of calculation of:

(A) the estimated treatment chemical concentration (C) from a charge balance equation and (B) an estimated boiler water conductivity (K') using Kohlrausch's law to enable calculation of the relative conductivity ratio (RCR) using the following equation:

$$RCR = K'/(|K - K'|),$$

with the further steps of:

(1) noting the critical conductivity ratio (CCR) which is the level below which significant corrosion of the protective magnetite layer on the boiler walls is observed, and (2) noting the observed maximum tolerable high temperature conductivity value (M), and then comparing (1) the relative conductivity ratio (RCR) with the critical conductivity ratio (CCR) and comparing (2) the value of the electrolytic conductivity of the boiler water at the operating temperature (K) with the maximum tolerable high temperature conductivity value (M), (a) whereby if the value of RCR is greater than the value of CCR and if the value of K is less than the value of M, then the boiler chemistry is under control and the current rate of chemical feed is continued.

(b) whereby if K is greater than M, then the blowdown rate is increased until K is less than M and if the value of RCR is less than the value of CCR, then the chemical feedrate is increased until the value of RCR is greater than the value of CCR (c) whereby if the value of RCR is less than the value of CCR and if the value of K is greater than the value of M, then the chemical feedrate and the blowdown rate are simultaneously increased until the value of RCR is greater than the value of CCR and the value of K is less than the value of M.

2. The method of claim 1 involving the use of all volatile treatment in the boiler to provide a degree of protection against corrosion of the magnetite layer.

3. The method of claim 1 involving an alternative internal treatment program (other than AVT).

4. The method of claim 1 involving on-line monitoring.

5. The method of claim 1 involving the estimation of a reliable value of the buffering capacity of the boiler water at operating temperature.

6. The method of claim 1 wherein the preferred treatment compound is diethanolamine.

* * * * *